United States Patent [19]

Eggert et al.

[11] 3,990,372

[45] Nov. 9, 1976

[54] RAILWAY VEHICLE ARTICULATED TRUCK

[75] Inventors: Walter S. Eggert, Huntingdon Valley; James M. Herring, Jr., Merion Station, both of Pa.

[73] Assignee: The Budd Company, Troy, Mich.

[22] Filed: Feb. 18, 1975

[21] Appl. No.: 550,252

[52] U.S. Cl. ..... 105/135; 105/136; 105/182 R; 105/185; 105/197 T; 105/199 A; 105/208.2; 105/224.1

[51] Int. Cl.[2] ..... B61F 3/04; B61F 5/08; B61F 5/20; B61F 5/24

[58] Field of Search ..... 105/133, 135, 136, 165, 105/167, 168, 182 E, 182 R, 183, 185, 197 T, 199 A, 199 CB, 199 R, 218 R, 208.2, 224.1

[56] References Cited

UNITED STATES PATENTS

| | | | |
|---|---|---|---|
| 690,330 | 12/1901 | Timmis | 105/199 R |
| 825,723 | 7/1906 | Hatcher | 105/199 CB |
| 2,349,601 | 5/1944 | Alben et al. | 105/218 R |
| 2,562,573 | 7/1951 | Piron | 105/182 R |
| 2,879,718 | 3/1959 | Eksergian | 105/185 |
| 2,908,230 | 10/1959 | Dean | 105/182 R |
| 2,976,819 | 3/1961 | Rossell | 105/182 R X |
| 3,398,700 | 8/1968 | Baker | 105/182 R |
| 3,455,252 | 7/1969 | Lich | 105/199 A |
| 3,516,365 | 6/1970 | Lich | 105/133 |
| 3,523,505 | 4/1970 | Lich | 105/208.2 X |
| 3,661,097 | 5/1972 | Jackson | 105/182 R X |
| 3,830,166 | 8/1974 | Dieling et al. | 105/182 E X |

*Primary Examiner*—Frank E. Werner
*Assistant Examiner*—Howard Beltran

[57] ABSTRACT

This application discloses a railway vehicle truck of a general configuration having independently movable side frames, wherein the side frames are provided with resilient connections with the wheel-axle units which allow universal turning movement but substantially inhibit relative axial movement; wherein the side frames are connected at longitudinally spaced points by transverse cross-frame or transom bar members which are rigidly connected to the side frames at one end and connected to opposite side frames by true turning shaft-bearing joints which also, when needed, provide limited axial movement, the shaft-bearing joints having axes disposed on a line passing through the vertical axis of turning of the truck whereby the transom bars positively maintain the truck in tram; wherein a center frame is mounted at longitudinally spaced laterally central points on the transom bars by resilient joints which are spaced approximately the same distance from the transverse vertical central plane of the truck as the shaft-bearing turning joints of the transom bars on the side frames, the resilient joints providing considerable vertical turning movement but restricting direct vertical movement; wherein the center frame provides a true turning shaft-bearing joint with the truck bolster; wherein the truck bolster is turnably supported by resiliently backed bearing plates on supporting surfaces on the side frames; wherein the vehicle body is supported by air springs located directly upon and above the side frames, the air springs being of a type to assist materially in controlling transverse movements and, in conjunction with air reservoirs and suitable orifice or valve means to assist in controlling vertical ride dynamics of the vehicle; wherein a frame carrying a drive motor and axle drive means is supported by the center frame in such manner that the movements of the motor frame are kept within proper limits relative to the axles; and wherein a transverse anti-roll bar suspension is provided to control roll dynamics of the truck bolster and the vehicle or car body carried thereon.

13 Claims, 9 Drawing Figures

Fig-3
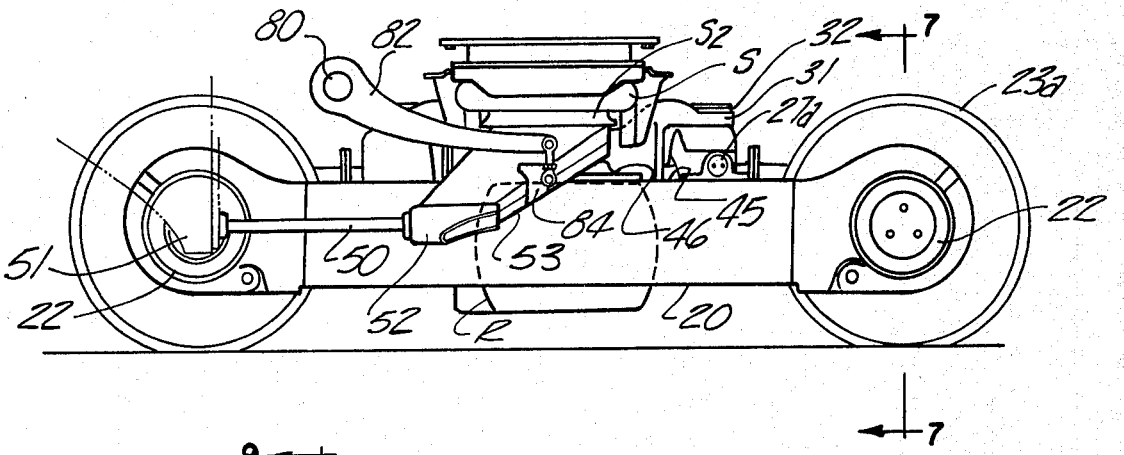
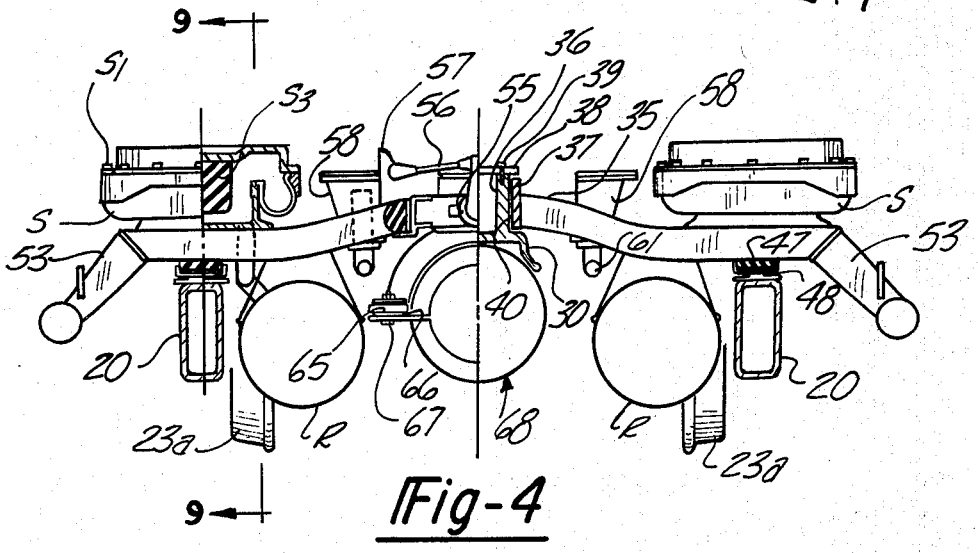
Fig-4
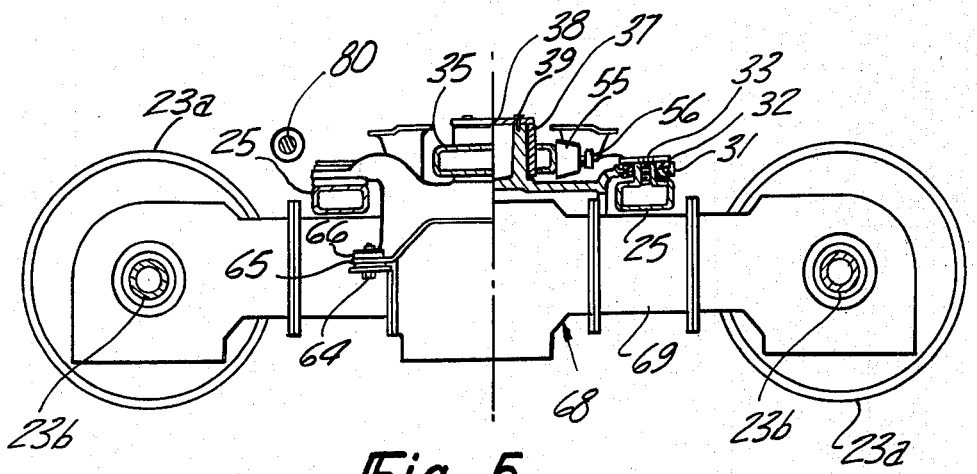
Fig-5

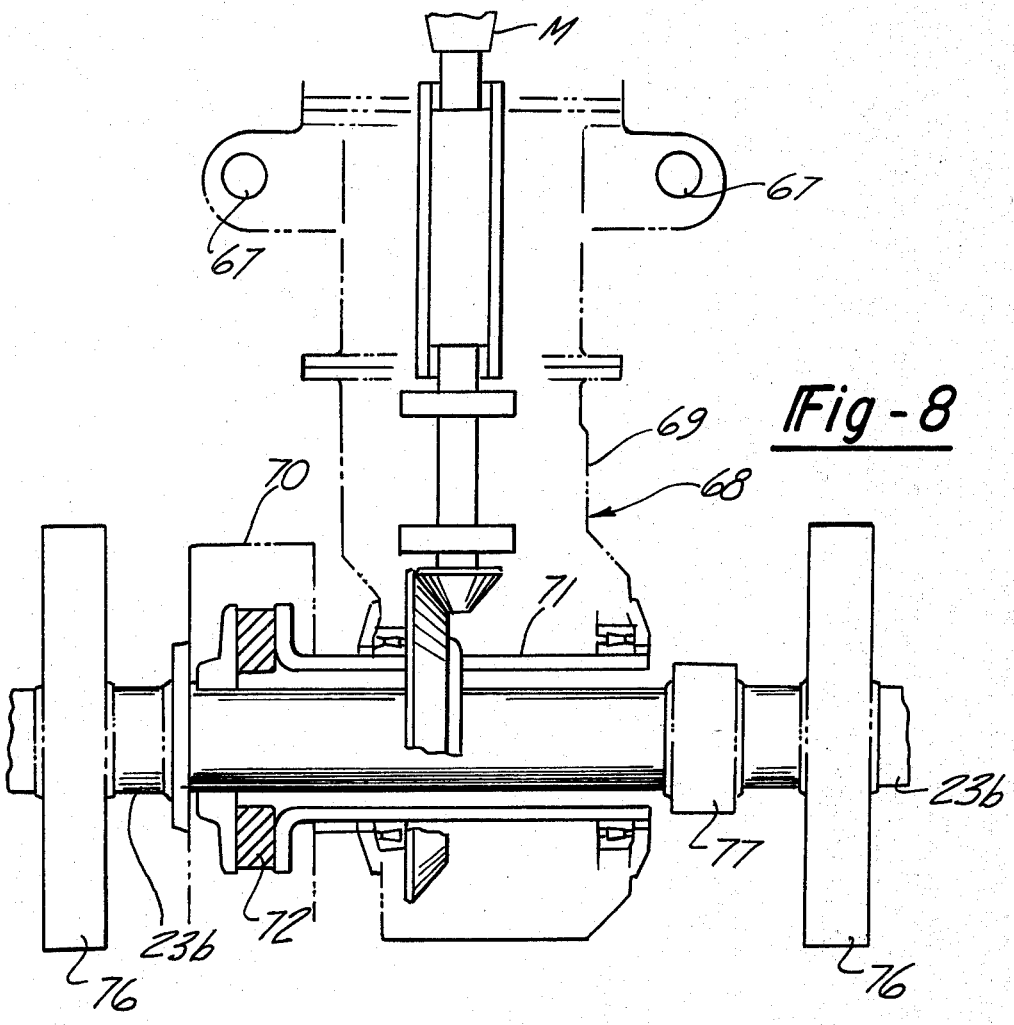
Fig-8
Fig-9
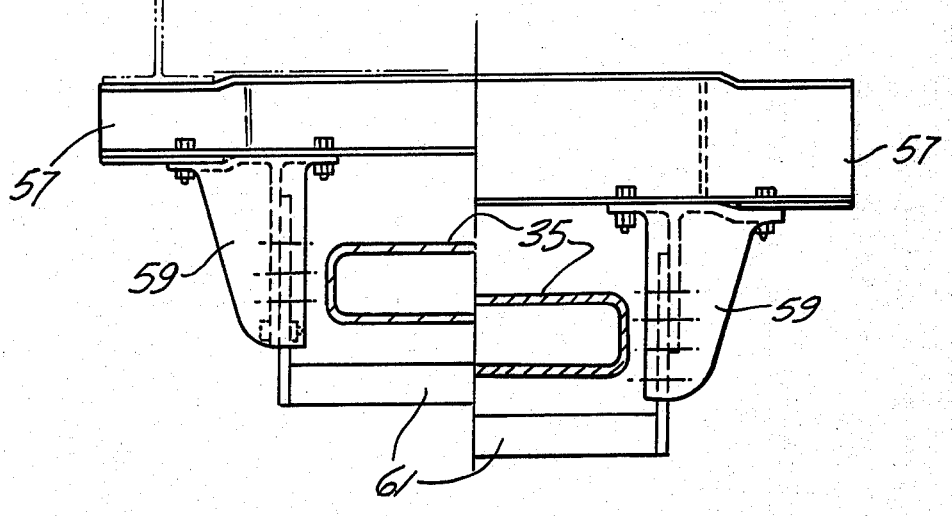

RAILWAY VEHICLE ARTICULATED TRUCK

BACKGROUND OF THE INVENTION

Heretofore there have been trucks having independently movable side frames, air springs supporting a car body on a bolster, a bolster turnably supported on side frames, said wheel-axle units having resilient bearing connections with the side frames.

One such truck having these characteristics was the "Pioneer" truck, U.S. Pat. No. 2,908,230, which, in various models, has such characteristics and has been extensively used for many years in both local and main line operation and has given economical and safe service over long periods of time with minimal attention.

Also there have been trucks having transom bars rigid with one side frame and having joint connections with the other side frame which provide universal movements, as through elastomeric connections or ball joints. For example, see U.S. Pat. No. 2,879,718.

However, so far as known, there have been no trucks of this type which provided the improvement in ride performance and control secured by the present invention. In particular, as a detail, the universal joints of the transom bars did not give positive control of truck tram.

SUMMARY OF INVENTION

The present invention aims to improve on former truck designs to provide a light weight truck having a new and improved organization which will give a smoother and better controlled ride with more accurate control of all relative movements of parts in the simple truck frame, and, when the axles are power driven, to closely control the movements of the motor-drive frame. The details of these improvements will be apparent as the description proceeds.

DRAWINGS

The objects and advantages of the invention, as well as various features of novelty, will be apparent from the following description of an exemplary embodiment thereof, reference being made to the accompanying drawings, wherein:

FIG. 3 is a side view of the truck;

FIG. 4 is a transverse vertical view partially in section taken on the line 4—4 of FIG. 2;

FIG. 5 is a longitudinal vertical view partially in section taken on the line 5—5 of FIG. 2;

FIG. 8 is a partial horizontal section taken on the line 8—8 of FIG. 6, showing axle drive means;

FIG. 9 is a longitudinal vertical view partially in section taken on the line 9—9 of FIG. 4, showing safety support arrangements for the truck bolster.

SPECIFIC EMBODIMENT

Figure 1:
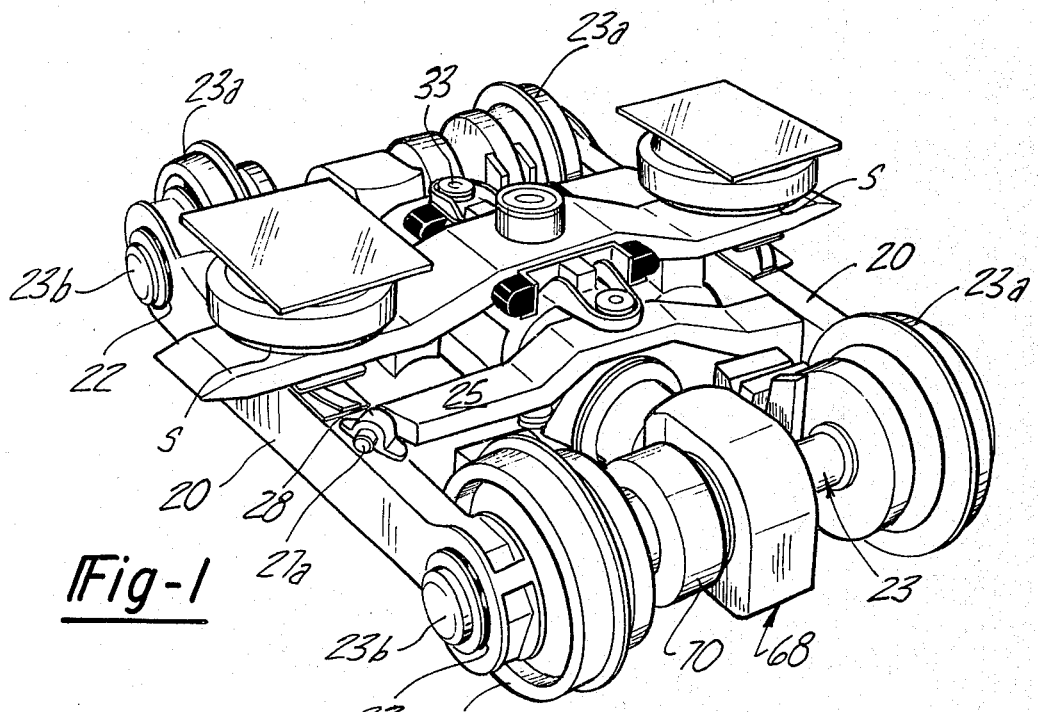
FIG. 1 is a prospective view of a railway truck embodying the present invention.
Figure 2:
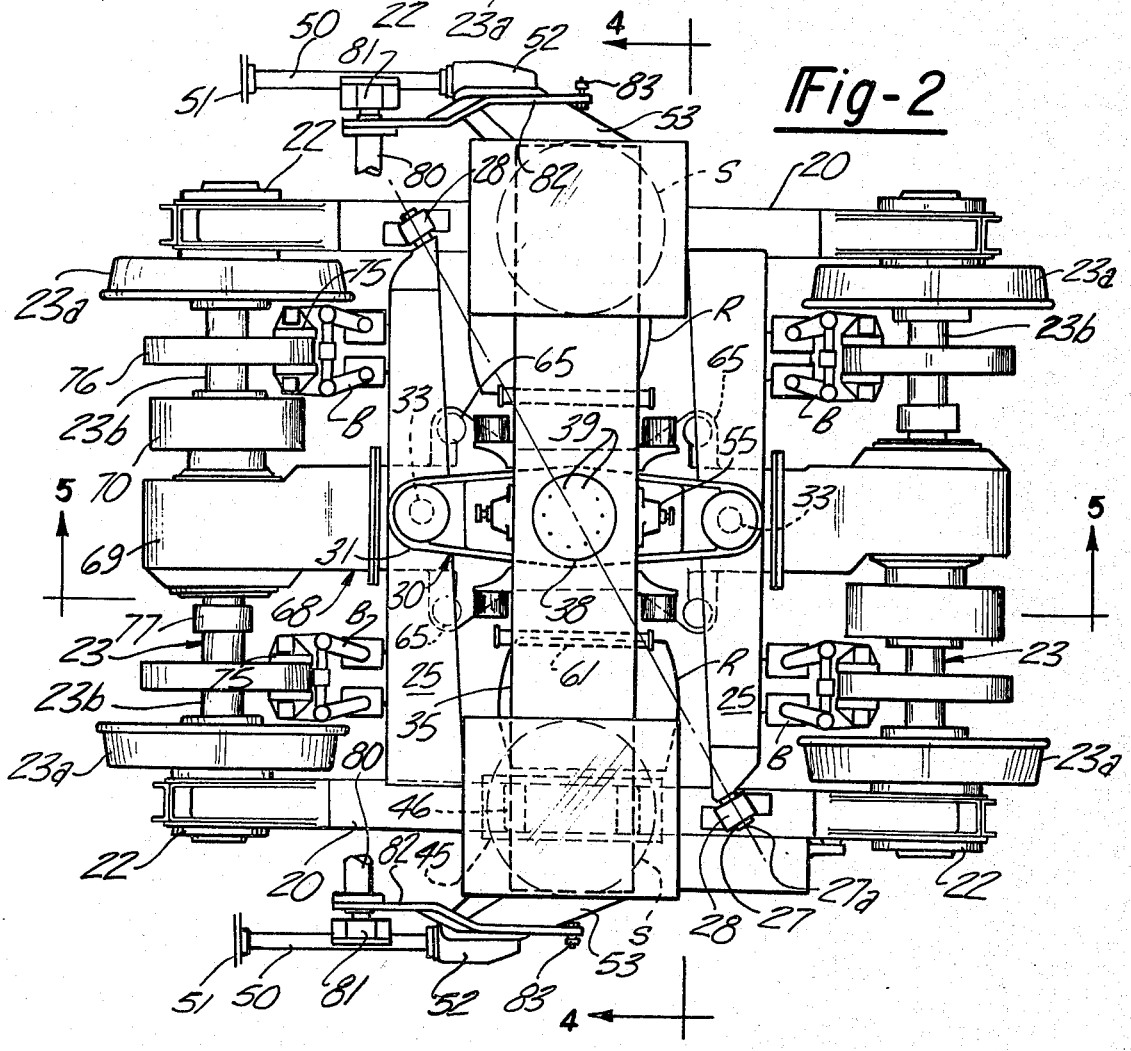
FIG. 2 is a top plan view of a railway vehicle truck embodying the invention.
Figure 6:
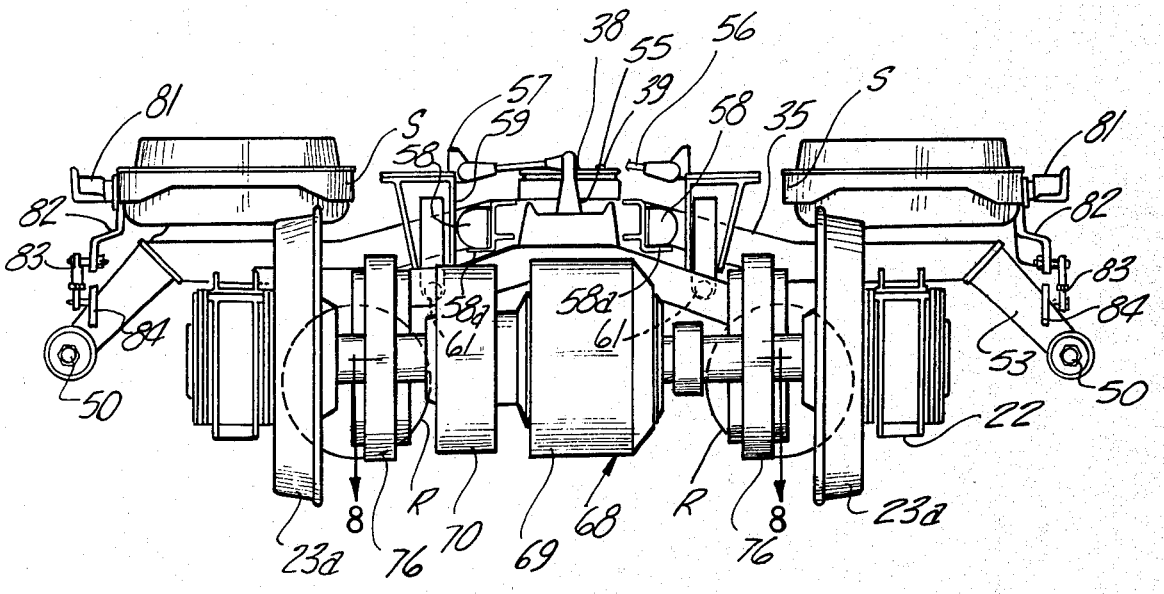
FIG. 6 is an end elevational view of the truck.
Figure 7:
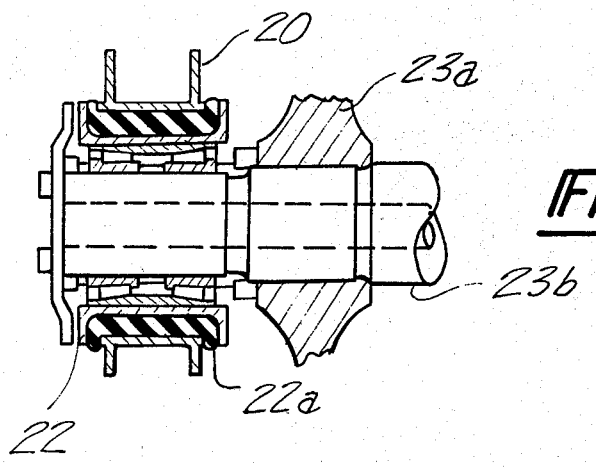
FIG. 7 is a partial vertical transverse section taken on the line 7—7 of FIG. 3, showing axle-to-side-frame connection.

As shown, the truck comprises two separate independently movable side frames 20 of hollow rigid construction connected at the ends of resilient bearing joints 22, as including elastomeric material 22*a*, (FIG. 7) with wheel-axle units 23 (wheels 23*a* and axles 23*b*), these joint connections allowing universal turning movement about three coordinate axes but inhibiting or substantially preventing axial or transverse movement. These joint connections hold the side frames at a fixed distance apart.

The side frames are positively held together in tram, but with free weaving movement, by strong rigid transverse transom bars 25 located at suitable distances fore and aft of a central transverse vertical plane of the truck. One end of each transom bar is made rigidly integral with a side frame 20, as by welding, and the other end is formed as a journal or shaft 27 which is rotatably mounted in a bearing 28 of the opposite side frame.

The transom bars are reversely mounted, one being rigidly secured to the side frame on which the other transom bar has a bearing connection. It is to be noted that the journals 27 are axially aligned with each other along a line L passing through the central vertical turning axis of the truck. Due to the location of the journal bearing joints in a convenient location on top of the side frames and above the horizontal plane of the wheel-axle bearings, the journals will have some axial sliding movement in their bearings as the side frames weave relative to each other but will retain their status as true shaft-bearing joints, no resilient elements or ball joints being involved. Consequently the transom bars strongly maintain the squareness or tram of the truck. Caps 27*a* are secured to the outer ends of the journals, as by cap screws, to prevent separation at the bearings under extreme conditions, such as a collision or lift of the truck with the vehicle. The line L of the axis of the transom bar journals may have different positions relative to the central transverse vertical plane, the position here shown being about 30°.

The transom bars, having true shaft bearings, provide positive means for maintaining the truck squareness or tram while allowing the required weave of the side frames. Universal joints, such as ball joints or elastomeric supports do not provide such positive control of tram.

A center plate or frame 30 is supported on the transom bars 25, having transversely central longitudinal projections 31 positioned above the transom bars (above for fail safe) and connected to the transom bars by suitable joints including resilient elements 32 and retaining pins 33. The resilient elements are wide and thin and provide ample turning movements in vertical planes but allow but little direct vertical movement. The transverse central position of these joints minimizes relative turning movement and vertical movement tendency. The longitudinal position shown is approximately on or near a transverse vertical plane which passes through a journal 27 about mid-length in its bearing.

The center frame 30 has a center king post connection with a truck bolster 35, here the center frame having a large upstanding tubular center king pin or post 36 disposed within a center bearing 37 of the bolster. The center pin is retained by a cap 38 held by screws 39. A friction-reducing sleeve 40 is disposed between the pin or post and the bearing. This may be a known plastic-graphite element, as with teflon, or the like. It provides a slight resiliency but the connection is still essentially a true shaft-bearing joint and maintains the parts in definite relative position. Some prior trucks have had center connections with considerable loose movement or wobble and have been hard to control and subject to undue wear.

The truck bolster 35 is turnably supported on the side frames 20. The side frames have bearing surfaces or plates 45 and the truck bolster has pads or shoes 46 backed by resilient elements 47, height adjusting shims 48 being interposed between the pads and the resilient elements.

The bolster 35, above the side frame bearing support, is provided with spring means S supporting a vehicle or car body, the spring means here employed being air spring units having the upper end S1 connected to the vehicle body and the lower end S2 connected to the bolster. An interior elastomeric stop member S3 limits maximum vertical movement to provide an acceptable failsafe ride.

The truck bolster 35 is held in proper longitudinal position relative to the vehicle body by longitudinal stay bars 50, connected by flexible joints to brackets 51 secured to the vehicle body and by flexible joints to brackets 52 carried by downturned portions 53 of the truck bolster. These flexible joints, of known type, as of elastomeric material, permit all necessary vertical movements of the truck bolster and such lateral movements as are permitted.

Lateral movement of the truck bolster is damped by shock absorbers 55 operated by links 56 connected to supports 57 depending from the vehicle body. Maximum lateral movement is limited by elastomeric bumpers 58 carried by side brackets 58*a*, secured, as by welding, to the bolster, the bumpers engaging brackets 59 depending from the vehicle body.

The brackets 58 also carry a vertically adjustable safety strap 61 which will support the truck transom, and through connections, support the truck in case the truck is lifted with or tends to separate from the vehicle body. FIG. 8 shows how the support members 57 may be exchanged as between shallow (left) and deep (right) members to fit the dimensional needs of the vehicle and truck.

The center frame 30, at the sides, carries depending support portions 65 on which, by resilient joints 66 and connecting bolts 67, is carried a rigid motor and gear box frame or casing 68 supporting a centrally disposed motor M and having longitudinally extending portions 69 with lateral extensions 70 at the axles for driving the axles while permitting free weaving movement between the axles and frame or casing. FIG. 8 shows the drive connection at the axle in detail. A ring gear sleeve 71 loosely surrounds the axle and drives it through a flexible connection 72 at one end.

The truck bolster 35 at the sides near the air springs S has secured thereon, as by welded brackets R1, air reservoirs R which have suitable flow connections with the air springs to aid the spring action control, valves or orifices being provided at suitable locations to adjust the action as desired. It is not considered pertinent to illustrate these connections, valves, orifices and the like since, in general, they are conventional.

The transom bars 25 support brake operating units B which have shoes 75 acting on brake disks 76 carried by the axles 23*b* of the truck, suitable relative movement of the brake unit being provided in its mounting supports.

The axles 25*b* also carry electrical brush rings 77 for connection through brushes and conductors (not shown) with the drive motor to establish a more reliable connection with the rail than would be furnished through the axle connections with the motor conductors. On a powered truck there will be a third rail shoe mount for power connections but it is not necessary to show this.

An anti-roll torque bar suspension 80 extends across the truck, being mounted in bearings 81 carried by the vehicle body and is connected with opposite ends of the truck bolster by arms 82 and links 83, with suitable pivot connections at the arm ends and brackets 84 carried by the bolster.

It is thus seen that the invention provides a new and improved truck assembly which gives more precise control of relative movements of parts. The true shaft-bearing joints of the transom bars on the side frames provide all needed relative weaving movements of the side frames and provide positive tram control which could not be obtained by joints having universal movement, as ball joints or elastomeric connections.

The provision of the center plate mounted on laterally central resilient supports on the transom bars allows the bolster to have a king pin joint with true shaft-bearing joint movement. The center plate also furnishes a suitable support for the motor drive frame so that it can have its required operative position and flexible drive of the axles. The arrangement places the spring support of the vehicle on the bolster directly above the side frames and provision of resiliently backed turning pads on the bolster provides better control of movements and better protection of parts.

This truck system provides a plurality of suspension elements or points wherein each performs its function independently of the others and is subject to separate and independent design and control. There are two vertical suspension elements, the wheel-axle connection and the air spring connections. And there are two lateral suspension elements or points, the pull connection through the bolster center pin and the transverse connection through the torque bar. While one embodiment of the invention has been described for purposes of illustration, it is to be understood that there may be various embodiments and modifications within the general scope of the invention.

We claim:

1. A railway vehicle truck having a central vertical axis, comprising in combination, longitudinally extending parallel spaced side frames, wheel-axle units supporting said side frames at longitudinally spaced points, and longitudinally spaced parallel transverse transom bars between said side frames at right angles thereto, said transom bars each being rigidly connected at one end to one of said side frames and being connected to the other side frame in a true shaft-bearing turning joint, where the transom bars are spaced longitudinally where connected to the side frames in opposite complementary angular relationship, the shaft bearing axis of each of said joints being located on a coincident axis passing through the vertical turning axis of the truck.

2. A railway vehicle truck as set forth in claim 1, in which a center frame is resiliently mounted on said transom bars at joints located approximately in the central vertical longitudinal plane of the truck.

3. A railway vehicle truck as set forth in claim 2, which further includes a rigid motor-gear drive frame mounted on said center frame, said drive frame having resilient mounting joints on said center frame and drive connections with said axles.

4. A railway vehicle truck as set forth in claim 3, in which the resilient mounting joints of the drive frame on the center frame are located at the sides of a central vertical longitudinal plane and a central vertical transverse plane of the truck.

5. A railway vehicle truck as set forth in claim 1, wherein said side frames have turning plate supports a bolster having resiliently backed support pads carried on the turning plate supports of the side frames.

6. A railway vehicle truck as set forth in claim 5, wherein spring means on the bolster are located directly above the side frame turning plate supports for the bolster.

7. A railway vehicle truck as set forth in claim 5, which further includes a transverse anti-roll torsion bar adapted to be mounted on a vehicle body and connected to the bolster adjacent its ends.

8. A railway vehicle truck as set forth in claim 1, wherein the axis of said shaft-bearing is disposed at an angle relative to the length of the transom bar.

9. A railway vehicle truck as set forth in claim 1, which further includes a bolster turnably mounted on a center frame supported on said transom bars.

10. A railway vehicle truck as set forth in claim 9, in which the bolster, which has turning movement on said center frame, is supported for turning movement on said side frames.

11. A railway vehicle truck as set forth in claim 1, which further includes a motor-drive frame mounted on a center frame supported on said transom bar.

12. A railway vehicle truck as set forth in claim 1, wherein said shaft-bearing axis is located above the plane of the truck axles and is provided with some axial sliding movement.

13. A railway vehicle truck as set forth in claim 12, which further includes means to limit the axial movement at said shaft-bearing joints to prevent separation of the transom bars from the side frames.

* * * * *